United States Patent [19]

Haas

[11] 3,942,683

[45] Mar. 9, 1976

[54] TABLET DISPENSING RECEPTACLE

[76] Inventor: Eduard Haas, Parkring 10, A-1010 Vienna, Austria

[22] Filed: Sept. 16, 1974

[21] Appl. No.: 506,749

Related U.S. Application Data

[63] Continuation-in-part of Ser. No. 300,487, Oct. 25, 1972, abandoned.

[30] Foreign Application Priority Data

Nov. 9, 1971 Austria ..... 9677/71

[52] U.S. Cl. ..... 221/229

[51] Int. Cl.[2] ..... B65H 1/12

[58] Field of Search ..... 221/229; 184/91; 222/566

[56] References Cited

UNITED STATES PATENTS

| | | | |
|---|---|---|---|
| 2,853,206 | 9/1958 | Uxa | 221/229 |
| 3,120,879 | 2/1964 | Warner | 184/91 |
| 3,300,106 | 1/1967 | Chmela | 222/566 |

*Primary Examiner*—Stanley H. Tollberg
*Attorney, Agent, or Firm*—Kurt Kelman

[57] ABSTRACT

In a tablet dispensing receptacle whose housing carries a spring-biased cover designed to dispense an uppermost tablet from the housing upon pivoting, the spring bias for the cover is provided by an elastically deformable transverse ledge extending between side wall extensions of the housing in a horizontal plane and integral with the side wall extensions and a bent-over spring leaf integrally projecting from the ledge so that the ledge and leaf spring constitute a spring. The outer end of the bent-over leaf spring engages an abutment of the cover for pushing the uppermost tablet and dispensing it from the receptacle housing when the cover is pivoted about its pivoting axis against the spring bias which normally holds the cover in closed position. The pivoting axis extends below the horizontal plane defined by the ledge.

8 Claims, 3 Drawing Figures

TABLET DISPENSING RECEPTACLE

This is a continuation-in-part of my copending U.S. application Ser. No. 300,487, filed Oct. 25, 1972, now abandoned.

The present invention relates to improvements in receptacles for receiving and sequentially dispensing individual shaped bodies from a stack of like shaped bodies received in the receptacle.

Austrian Pat. No. 166,326 and corresponding U.S. Pat. No. 2,620,061 discloses a receptacle, one of the receptacle parts being a housing having a dispensing end and the other receptacle part being a pivotal cover at the dispensing end. Spring means in the housing presses the stack of shaped bodies, such as tablets, towards the dispensing end to place sequential uppermost shaped bodies of the stack into a dispensing position, a spring biases the pivotal cover into a closed position, and the cover has a portion pushing the uppermost shaped body and dispensing it from the receptacle when the cover is pivoted against the spring bias.

This type of dispensing receptacle has found wide commercial acceptance for use with a great variety of tablets. The receptacle disclosed in the indicated patents carries a laterally open drawer within the receptacle housing, a spring-biased bottom for the drawer which presses the stack of tablets towards the dispensing end of the housing, and the side walls of the receptacle housing have extensions at the dispensing end which supports the cover. Another part of the receptacle is the cover spring. All the parts of the receptacle are assembled manually. Considering the steady increase in wages for manual labor, this has made the manufacture of these receptacles correspondingly more expensive.

A similar tablet dispensing receptacle is disclosed in U.S. Pat. No. 2,853,206, except that it omits a special drawer holding the tablets. However, it still provides a separate spring for biasing the cover.

It is the primary object of this invention to overcome this disadvantage in the manufacture of receptacles of the indicated type and to simplify the assembly of the receptacle parts, more particularly by doing away with a separate cover spring whose assembly involved an especially time-consuming operation.

The above and other objects are accomplished in accordance with the invention by making the spring which biases the pivotal cover into a closed position integral with the cover of the receptacle.

According to a preferred embodiment of the present invention, the receptacle housing integral with the spring is an injection molded thermoplastic resin body, for instance of polystyrene.

According to this invention, an elastically deformable transverse ledge extends between side wall extensions of the receptacle housing in a horizontal plane and is integral with the side wall extensions. The housing receives and sequentially dispenses individual shaped bodies, such as tablets, from a stack of like ones of the bodies received in the housing and the uppermost shaped body is pressed against the ledge by spring means in the housing which presses the stack of shaped bodies towards the dispensing end of the housing to place sequential uppermost ones of the shaped bodies of the stack into a dispensing position between the side wall extensions of the housing. A bent-over leaf spring integrally projects from the ledge, the integral ledge and leaf constituting a spring. The outer end of the bent-over leaf spring engages an abutment of the cover which is pivotally mounted on the side wall extensions at the dispensing end about a transverse pivoting axis which extends above the horizontal plane defined by the ledge, the abutment being adjacent the pivot for pushing the uppermost shaped body and dispensing it from the receptacle housing when the cover is pivoted about the pivoting axis. The spring biases the pivotal cover into a closed position and permits pivoting of the cover about the pivoting axis against the spring bias into an open and dispensing position.

If receptacles of this type are to be used repeatedly for refills, it is important to impart a long operating life to the spring. It has been found that the use of a bent-over leaf spring well fulfills this purpose because the zone of flexing is transferred almost exclusively into the material of the leaf spring itself, rather than the connecting point between the ledge and the leaf spring, so as to minimize wear and breakage of the spring.

The above and other objects, advantages and features of the present invention will more fully be understood by reference to the following detailed description of a now preferred embodiment thereof, taken in conjunction with the accompanying drawing wherein FIG. 1 is a longitudinal section along line I—I of FIG. 2 of a receptacle according to this invention;

Figure 2:
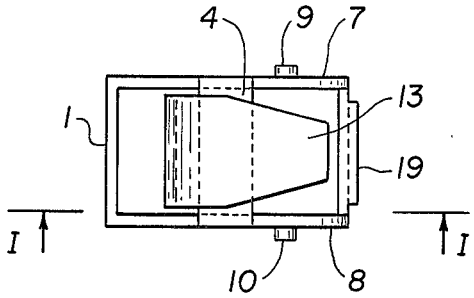
FIG. 2 is a top view of the spring arrangement, with the cover removed.

Referring now to the drawing, the receptacle is shown to comprise housing 1 receiving a stack of like shaped bodies, such as tablets 2, which are sequentially dispensed from the receptacle housing. A spring means constituted by compression spring 3 is mounted in the receptacle housing between fixed bottom 6 and movable tablet stack support bottom 5 for pressing the stack of tablets 2 towards the dispensing end of housing 1 to place sequential uppermost tablets of the stack into a dispensing position.

As shown, housing 1 has side wall extensions 7 and 8 carrying a pair of pivot pins 9 and 10 which receive bearing bores 12 of cover 11 for pivotally supporting the cover on the side wall extensions for pivoting about an axis defined by the pivot pins.

Figure 1:
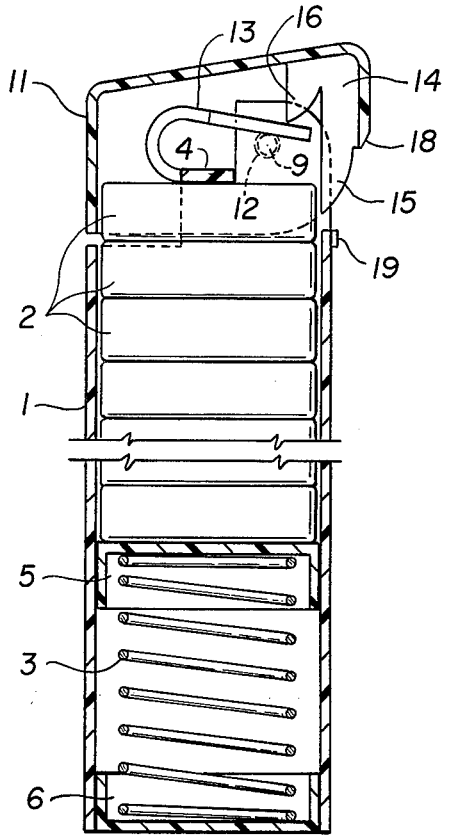

Elastically deformable transverse ledge 4 extends between the side wall extensions of the housing in a horizontal plane and is integral with the side wall extensions, the uppermost tablet 2 being pressed by compression spring 3 against ledge 4 into the dispensing position which is delimited by ledge 4 and side wall extensions 7, 8. Bent-over leaf spring 13 integrally projects from ledge 4, the leaf spring bulging slightly forwardly from the ledge, as seen in FIGS. 1 and 3, so that its inner end is bent 180° and then runs backwards, with the outer end of the leaf spring engaging abutment 14 of the cover.

The cover abutment is adjacent pivot 9, 10 of the cover and the pivoting axis is above the horizontal plane defined by ledge 4 so that the abutment pushes the uppermost tablet in the dispensing position from housing 1 when cover 11 is pivoted about the pivoting axis in the direction of arrow 17 to reach the open position shown in FIG. 2. In the illustrated embodiment, abutment 14 is fork-shaped and has a shoulder portion 16 engaging the outer end of leaf spring 13 and biasing the same downwardly, and a dispensing portion 15 extending from the shoulder portion below the spring leaf for engaging the uppermost tablet and dispensing it upon pivoting of the cover against the spring bias. The integral ledge and leaf spring constitute the spring normally biasing the cover into its closed position shown in FIG. 1 and the outer end of the leaf spring is received in the slot defined between shoulder portion 16 and dispensing portion 15 of cover abutment 14. This arrangement makes it unnecessary to provide a special shoulder in the cover for engaging the outer leaf spring end. The abutment shoulder portion is spaced upwardly from the horizontal plane defined by ledge 4 and the abutment dispensing portion has an arcuate outer surface moving into the dispensing position between the side wall extensions of the housing upon pivoting of the cover. This makes it possible to decrease the depth of the cover.

Figure 3:
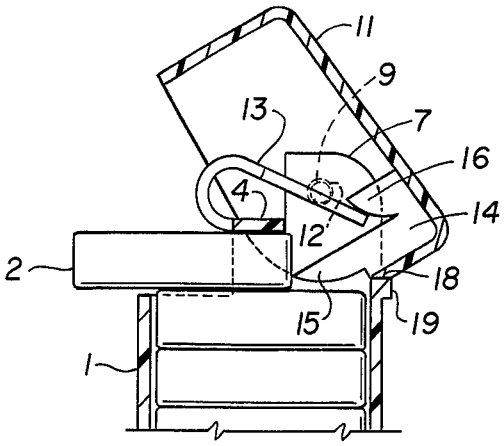
FIG. 3 shows the top of FIG. 1, with open cover in dispensing position.

It will be noted from FIG. 3 that pivoting of the cover caused shoulder portion 16 to depress the outer end of leaf spring 13, thus loading the spring, while dispensing portion 15 pushes the tablet forwardly and out of receptacle housing 1. When the pivoting pressure on the cover is released, the loaded spring will automatically return the cover into its closed position and spring 3 will push the stack up to place the next tablet into a dispensing position.

It will be simple to injection mold housing 1 with the spring consisting of ledge 4 and leaf spring 13 integral therewith, the housing and spring forming an integral unit. Any sheet-forming thermoplastic synthetic resin may be used for this purpose, polystyrene being preferred, and the thickness of the ledge and leaf spring is such that they are elastically deformable. Suitable synthetic resins which are form-retaining under ambient temperatures but permit elastic deformation in the selected gage may be readily selected by those skilled in the art and, while injection molding will be particularly inexpensive, the unit may also be produced in different ways and from different materials, such as sheet metal.

Since the primary zone of flexing of the spring is transferred from the point of connection between ledge 4 and leaf spring 13 towards the outer end of the leaf spring beyond its 180° bulge, breakage at the latter point will be delayed. This prolongs the life of the receptacle.

Because the spring formation in accordance with the present invention requires the pivoting axis of the cover to be positioned above ledge 4, the cover would have to have considerable depth if abutment 14 extended perpendicularly. It has, therefore, been proposed to shape the shoulder and dispensing portions of the abutment arcuately so that they project inwardly into the dispensing end of housing 1 delimited by side wall extensions 7 and 8. This makes it possible considerably to decrease the depth of cover 11.

The springiness of leaf spring 13 may be influenced by tapering its width from the ledge towards the outer end thereof, as shown in FIG. 2, the outer end being narrower than the bulge connecting the leaf spring to the ledge. This makes the pivoting of the cover responsive to a very light pressure and thus further increases the life of the spring.

As shown, the end wall of receptacle housing 1 may have a shoulder 19 cooperating with stop 18 on cover 11 to limit the pivoting range of the cover.

What is claimed is:

1. In a receptacle having a housing for receiving and sequentially dispensing individual shaped bodies from a stack of like one of said bodies received in the housing, the housing having two side wall extensions at a dispensing end thereof, a cover pivotally mounted on the side wall extensions at the dispensing end about a transverse pivoting axis, the cover having an abutment adjacent the pivot for pushing an uppermost one of the shaped bodies and dispensing it from the receptacle housing when the cover is pivoted about the pivoting axis, and spring means in the housing for pressing the stack of shaped bodies towards the dispensing end to place sequential uppermost ones of the shaped bodies of the stack into a dispensing position, the improvement of an elastically deformable transverse ledge extending between the side wall extensions of the housing in a horizontal plane and integral with the side wall extensions, the uppermost shaped body being pressed by the spring means against the ledge, and a bent-over leaf spring integrally projecting from the ledge, the integral ledge and leaf spring constituting a spring, the outer end of the bent-over leaf spring engaging the abutment of the cover and the spring biasing the pivotal cover into a closed position and permitting pivoting of the cover about the pivoting axis against the spring bias into an open and dispensing position, and the pivoting axis extending above the horizontal plane defined by the ledge.

2. In the receptacle of claim 1, the leaf spring tapering in width from the ledge towards the outer end thereof.

3. In the receptacle of claim 1, the abutment of the cover having a shoulder portion engaging the outer end of the leaf spring and biasing the same downwardly and a dispensing portion extending from the shoulder portion below the spring leaf for engaging the uppermost shaped body and dispensing it upon pivoting of the cover against the spring bias.

4. In the receptacle of claim 3, the abutment dispensing portion having an arcuate outer surface.

5. In the receptacle of claim 3, the abutment shoulder portion being spaced upwardly from the horizontal plane defined by the ledge.

6. In the receptacle of claim 1, the leaf spring having an inner end projecting from the ledge and bent 180°.

7. In the receptacle of claim 1, the housing, with the integral ledge and leaf spring, and the cover being thermoplastic synthetic resin bodies.

8. In the receptacle of claim 7, the synthetic resin being polystyrene.

* * * * *